United States Patent [19]

Sugasawara et al.

[11] Patent Number: 5,011,029

[45] Date of Patent: Apr. 30, 1991

[54] COAT LIFT HANGER

[75] Inventors: Seiji Sugasawara; Ken Tsuneki; Kazuyoshi Ohshima; Yojiro Nakayama; Tatsuya Hayakawa; Seiichiro Tamura, all of Tokyo, Japan

[73] Assignee: Sugatsune Industrial Co., Ltd., Tokyo, Japan

[21] Appl. No.: 372,080

[22] Filed: Jun. 27, 1989

[30] Foreign Application Priority Data

Jun. 30, 1988 [JP] Japan ..... 63-163070
Jun. 16, 1989 [JP] Japan ..... 1-153726

[51] Int. Cl.[5] ..... A47F 5/08

[52] U.S. Cl. ..... 211/104; 16/54; 211/1.3; 248/292.1

[58] Field of Search ..... 248/292.1, 596, 598, 248/186, 185, 293; 267/290, 291, 293, 296; 211/104, 1.3; 16/68, 54, 84, D9

[56] References Cited

U.S. PATENT DOCUMENTS

| | | | |
|---|---|---|---|
| 902,635 | 9/1908 | Wowra | 248/292.1 X |
| 1,669,560 | 5/1928 | Himes | 248/598 X |
| 2,485,937 | 10/1949 | Swanson | 16/54 |
| 2,550,158 | 4/1951 | McCormick | 211/104 X |
| 2,778,705 | 1/1957 | Barker | 211/1.3 X |
| 3,211,295 | 10/1965 | Weiss | 211/104 X |
| 3,417,874 | 12/1968 | Bryant | 211/104 X |
| 4,171,748 | 10/1979 | Fabian | 211/1.3 |
| 4,325,164 | 4/1982 | Sasaki | 16/68 X |
| 4,413,373 | 11/1983 | Sasaki | 16/54 |
| 4,550,470 | 11/1985 | Omata | 16/DIG. 9 X |
| 4,576,252 | 3/1986 | Omata | 16/DIG. 9 X |
| 4,632,255 | 12/1986 | Kennedy | 211/104 X |
| 4,756,051 | 7/1988 | Shy | 16/54 X |
| 4,829,628 | 5/1989 | Vuksic | 16/54 |

FOREIGN PATENT DOCUMENTS

| | | | |
|---|---|---|---|
| 1126045 | 7/1956 | France | 211/1.3 |

*Primary Examiner*—David L. Talbott
*Assistant Examiner*—Daniel Hulseberg
*Attorney, Agent, or Firm*—Fleit, Jacobson, Cohn, Price, Holman & Stern

[57] ABSTRACT

There is provided a lift coat hanger comprising an ingenious damper that can be selectively operated with a view to decelerate the rotary motion of the arm and softly stopping it as it comes to the open or closed position, while the construction of the overall lift coat hanger is made rather simple and hence can be realized at a reduced cost.

2 Claims, 6 Drawing Sheets

COAT LIFT HANGER

BACKGROUND OF THE INVENTION

1. Field of the Invention

This invention relates to a so-called coat lift hanger for storing coats and/or other garments in a storage area located at a relatively high position of a wardrobe or wall in a room comprising a hanger pipe for removably hanging and storing coats and/or other garments, an arm capable of being pivotally tilted forward and be returned to its uprightly standing position for moving up and down said hanger pipe fitted to its upper end and a rotary lever located at a relatively low position for tilting and returning said arm.

2. Prior Art

There have been known several types of lift coat hangers comprising an arm capable of being pivotally tilted from its uprightly standing position, or closed position, for storing coats and/or other garments to a tilted forward low position, or open position, where coat hanging and removing operations are conducted, and then smoothly returned to its upright standing position by utilizing the restoring force of an expansion spring, a compression spring or a helical spring which is connected to the arm and resiliently deformed when the arm is tilted.

However, such a lift coat hanger hanger is accompanied by a serious drawback. Since the torque of the arm increases as the arm is pivoted downward to the open position, the arm can abruptly collapse to present unexpected hazards, if it is under a heavy load (or a large number of garments hanging there). On the other hand, the arm can swiftly turn upward from the open position to its upright closed position, if the load is very small since its restoring action is totally dependent on the force of the spring.

While the drawback may be removed through the provision of a one-way clutch or another sophisticated protection mechanism, it will inevitably raise the cost of the lift coat hanger system and requires a cumbersome operation for fitting it to the wardrobe or wall.

PROBLEM TO BE SOLVED BY THE INVENTION

It is therefore an object of the invention to solve the above problem of conventional lift coat hanger systems by using not only a spring for restoring the arm but also additionally a damper and a transmission/disconnection mechanism provided between the damper and the arm in such a manner that said damper has its effective areas for damping the driving force of the arm near the open and closed positions of the arm and consequently ensures a quick but quiet halting action of the arm at the open or closed position. Such a damper and transmission/disconnection mechanism should be mechanically simple and manufactured at a low cost, while they can be easily fitted to a wardrobe or wall.

It is another object of the present invention to solve the above problem of conventional lift coat hanger systems by using a compression spring for restoring the arm and at the same time a crank mechanism causing the spring to be compressed by rotation of the arm so that the torque transmitted to the arm by the restoring spring may be differentiated depending on the angular position of the arm, said torque being maximum at and around the middle of the stroke of the arm and minimum at and near the open and closed positions to ensure stabilized motion of the arm near the open and closed positions.

It is still another object of the present invention to solve the above problem of conventional lift coat hanger systems by using a transmission/disconnection mechanism comprising a rotary plate provided around the movable shaft of said damper on which there is formed a groove having an X-shape front view, into which the lower end of the arm is engaged such that the damper is operational only within desired ranges.

A still further object of the present invention is to solve the above problem of conventional life coat hanger systems by using a damper which, unlike the above description, comprises a movable disc to be rotated by a movable shaft located in a casing filled with viscous liquid and a transmission/disconnection mechanism located between said movable shaft and said movable disc to provide an effective damper having a simple construction.

MEANS TO SOLVE THE PROBLEM

According to the invention, the above problem is solved by providing a lift coat hanger comprising a hanger pipe for holding hangers, an arm capable of being pivotally tilted forward and returned to its uprightly standing position for moving up and down said hanger pipe fitted to its upper end, a rotary lever located at a relatively low position for tilting and returning said arm, a damper connected with the lower end of said arm for damping the rotary motion of said arm transmitted thereto from said arm by means of a movable shaft it comprises and a restoring spring means capable of restoring the arm from its forwardly tilted open position to its uprightly standing closed position by using the force stored in it by the arm when the arm is forwardly pivoted from the uprightly standing position to the forwardly tilted position, wherein said lift coat hanger further comprises a transmission/disconnection mechanism provided between said movable shaft of the damper and the lower end of the arm to make said damper selectively operational only within a predetermined range where the arm is moved down and comes close to the open position and a corresponding range where the arm is moved up and reaches the closed position (a first embodiment).

A preferred embodiment of the lift coat hanger according to the invention comprises a hanger pipe for holding hangers, an arm capable of being pivotally tilted forward and returned to its uprightly standing position for moving up and down said hanger pipe fitted to its upper end, a rotary lever located at a relatively low position for tilting and returning said arm, a damper connected with the lower end of said arm for damping the rotary motion of said arm transmitted thereto from said arm by means of a movable shaft it comprises and a restoring spring realized in the form of a compression spring having one end supported by said arm and the other end supported by a spring receiver slidably arranged on said arm and capable of restoring the arm from its forwardly tilted open position to its uprightly standing closed position by using the force stored in it by the arm, when the arm is forwardly pivoted from the uprightly standing position to the forwardly tilted position, wherein the lift coat hanger further comprises a crank mechanism constituted by said arm, a fixed plate rigidly fitted to the damper and a link arm pivotably connecting said spring receiver and a fixed plate and a transmission/disconnection mechanism provided between said movable shaft of the damper and the lower end of the arm to make said damper selectively operational only within a predetermined range where the arm is moved down and comes close to the open position and a corresponding range where the arm is moved up and reaches the closed position (a second embodiment).

Another preferred embodiment of the lift coat hanger according to the invention is similar to the above preferred embodiment but uses a transmission/disconnection mechanism comprising a rotary plate provided around the movable shaft of said damper on which there is formed a groove having an X-shape front view, into which the lower end of the arm is engaged, said groove having its side walls so formed that the lower end of the arm comes to abut the groove when the arm is moved down and comes close to the open position and when the arm is moved up and reaches the closed position to transmit the pivoting motion of the arm to the movable shaft of the damper (a third embodiment).

A still another preferred embodiment of the lift coat hanger according to the invention comprises a hanger pipe for holding hangers, an arm capable of being pivotally tilted forward and returned to its uprightly standing position for moving up and down said hanger pipe fitted to its upper end, a rotary lever located at a relatively low position for tilting and returning said arm, a damper connected with the lower end of said arm for damping the rotary motion of said arm transmitted thereto from said arm by means of a movable shaft it comprises and a restoring spring means capable of restoring the arm from its forwardly tilted open position to its uprightly standing closed position by using the force stored in it by the arm, when the arm is forwardly pivoted from the uprightly standing position to the forwardly tilted position, wherein said damper consists of a casing, viscous liquid contained in said casing and a movable shaft and its damping effect is realized by the viscous shearing resistance of the viscous liquid against the rotary movement of the movable shaft and said lift coat hanger further comprises a transmission/disconnection mechanism provided between said movable shaft of the damper and the lower end of the arm to make said damper selectively operational only within a predetermined range where the arm is moved down and comes close to the open position and a corresponding range where the arm is moved up and reaches the closed position (a fourth embodiment).

OPERATION

With the first embodiment of the lift coat hanger of the invention, the arm is rotated forward around the fulcrum of the arm until it reaches the foremost open position when a pulling force is applied to the rotary lever which transmitted it as a rotary force to the arm in the standing closed position.

When the arm is turned down, the restoring spring is deformed by the arm and stores a force to push up the arm, when it is returned to the upright position.

The arm can be retained to its open position by setting a change point or providing a hook device to hold the arm at that position.

While the damper does not exert its damping effect to the arm when that latter is moving toward the middle of its stroke from the upright position, its motion comes to be influenced by the damper when it moves further downward.

Therefore, the arm moves down rather rapidly until the middle point but its speed is reduced as it approaches the final open position where it completely halts.

When the arm is turned upward by means of the rotary lever, the arm moves rather quickly until the middle point because the damper does not work up to that point. However, as the arm approaches the upright closed position, the speed of the upward movement of the arm is reduced under the effect of the damper such that the arm is softly held immovable, when it reaches the uppermost position.

With the second embodiment of the lift coat hanger according to the invention, a compression spring is used for a restoring spring and a force to restore the arm is stored in the spring as it is compressed by the downward pivoting movement of the arm. It should be noted that the deflection of the spring becomes maximum when the center line of the arm comes on the line connecting the fulcrum of the arm and the pivot of the link arm located at the lower end thereof (changing point). Thus, as the arm turns further downward, the compression spring becomes expanded and therefore the force to restore the arm gradually declines until it becomes null when the arm reaches the lowest open position.

The third embodiment of the invention as described above comprises a transmission/disconnection mechanism realized in the form of a groove having a roughly X-shaped front view, to the side walls of which the lower end of the arm comes to abut to transmit its rotary movement to the movable shaft of the damper. Thus, the arm is subjected to a damping effect of the the damper in the predetermined ranges immediately before the open and closed positions.

The fourth embodiment of the invention comprises a transmission/disconnection mechanism located between the movable shaft of the damper and the movable disc in such a manner that, although the pivoting movement of the arm is always transmitted to the movable shaft, it does not drive the movable disc to rotate in a predetermined range of the stroke of the arm and the damper becomes operational only when the movable shaft drives the movable disc to cause the viscous liquid contained in the damper to generate shearing viscous resistance against the movable disc, ensuring a soft halting action of the arm at the open and closed positions.

Now the invention will be described in greater detail by referring to the accompanying drawings which illustrate preferred embodiments of the invention.

DETAILED DESCRIPTION OF THE INVENTION

Figure 1:
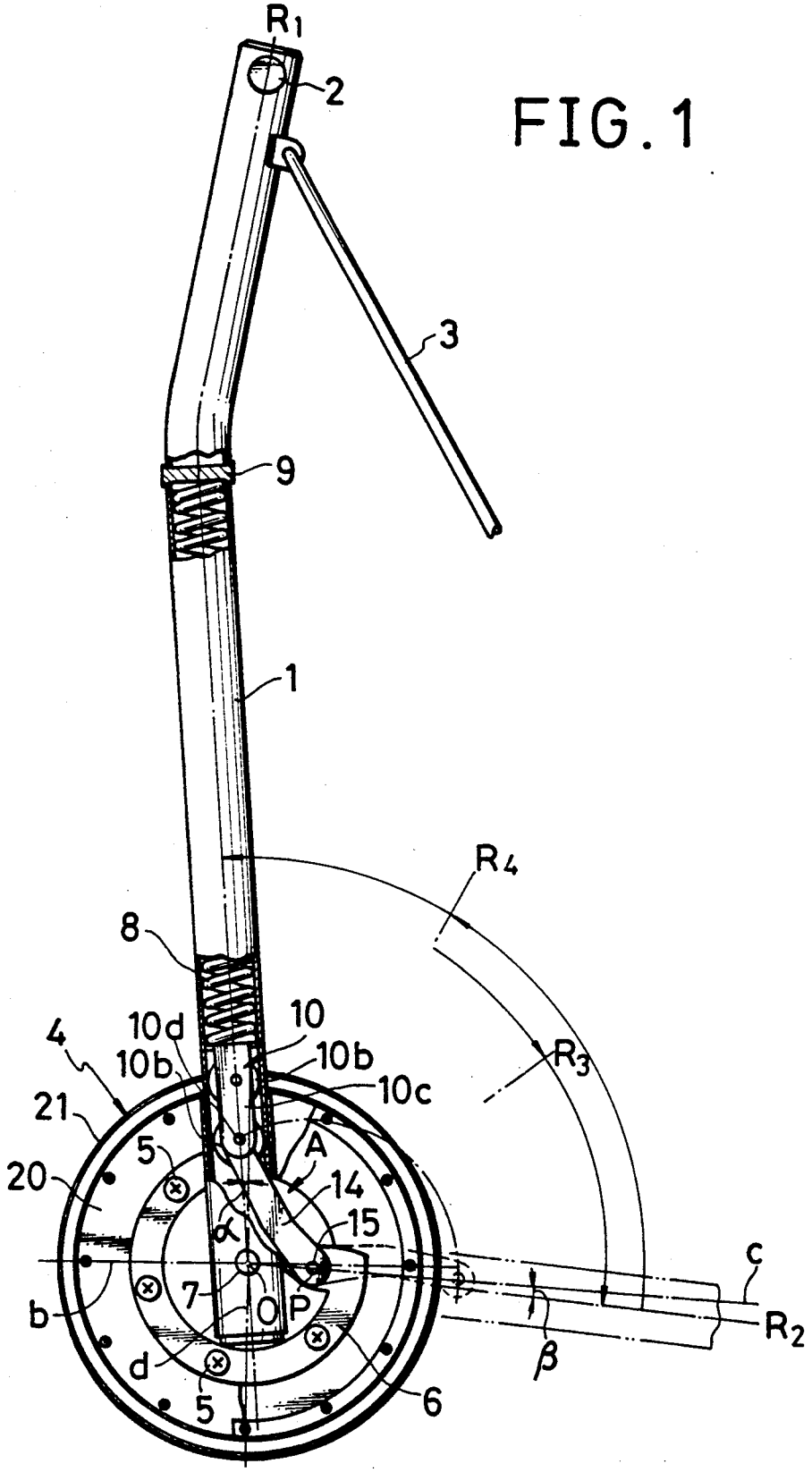
FIG. 1 is a partially cut-out side view of an embodiment of the lift coat hanger according to the invention.
Figure 2:
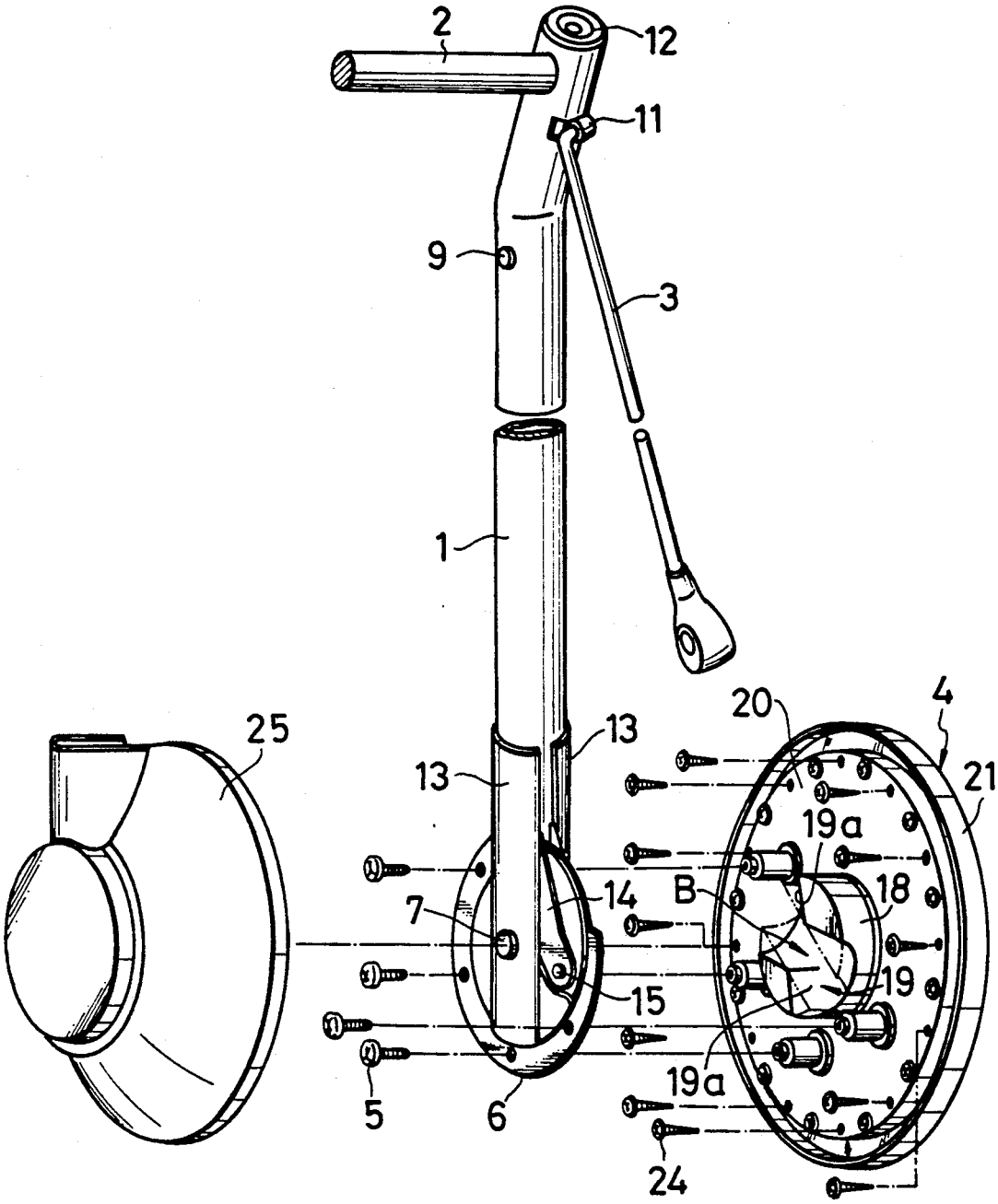
FIG. 2 is an exploded perspective view of the embodiment of FIG. 1 showing the arm, the crank mechanism and the damper.
Figure 3:
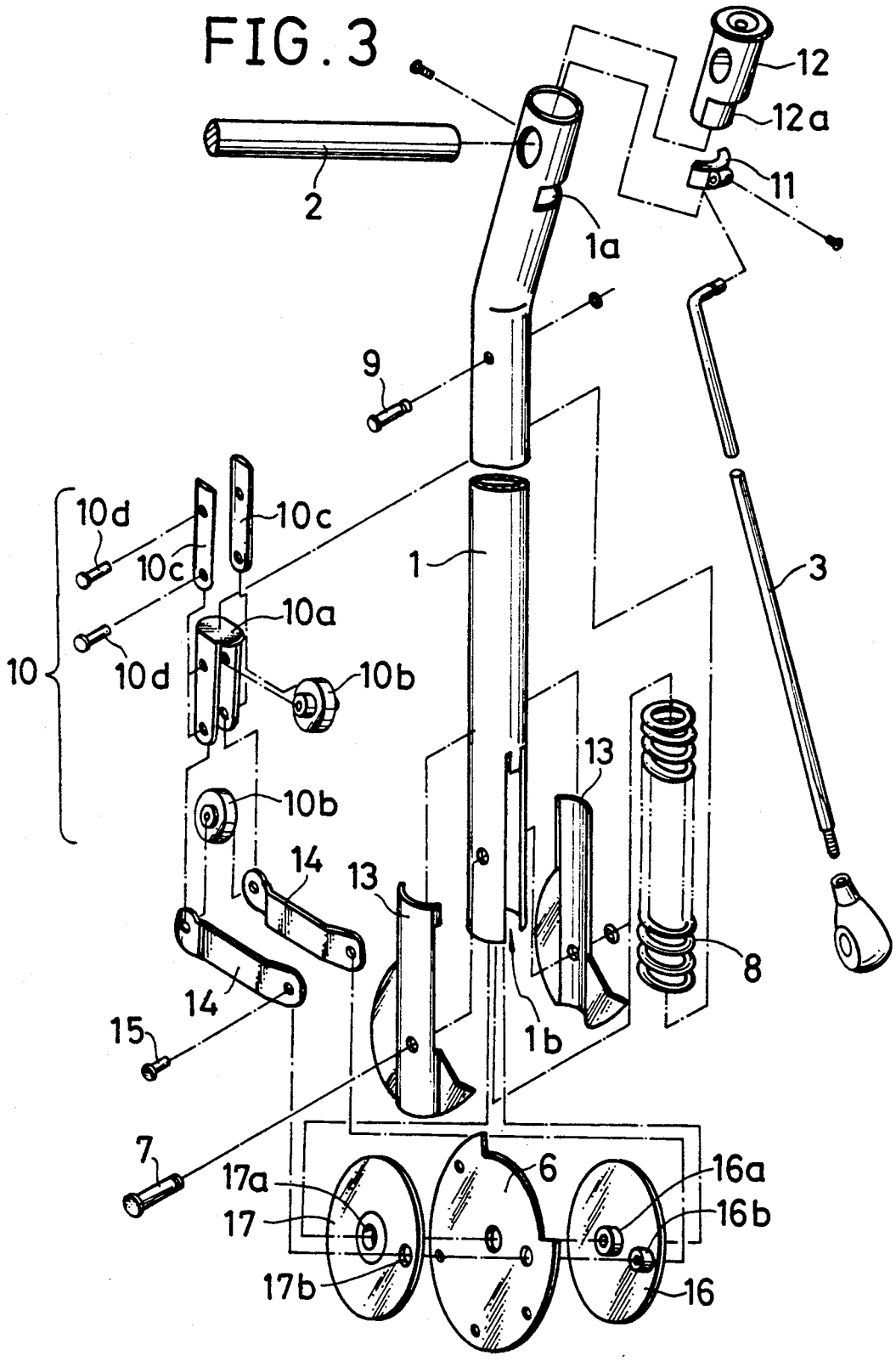
FIG. 3 is an exploded perspective view of the embodiment of FIG. 1 showing the arm and the crank mechanism.
Figure 4:
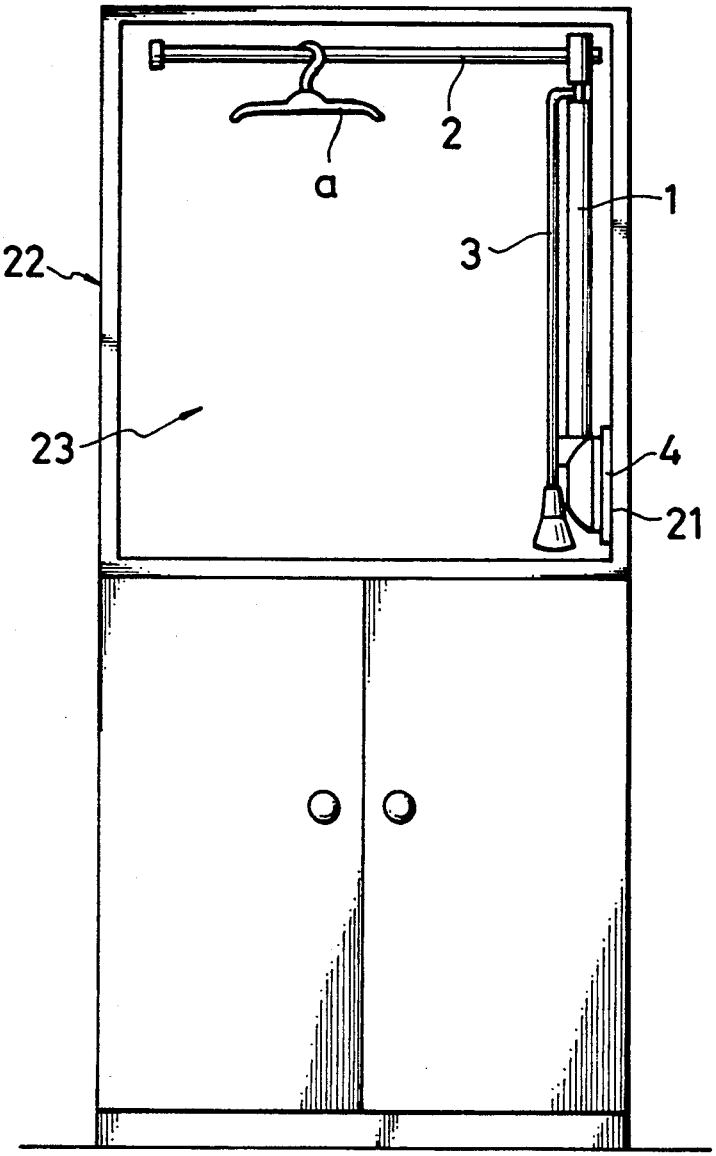
FIGS. 4 and 5 are respectively a front view and a sectional side view of the embodiment of FIG. 1 in an actual application.

Referring to FIGS. 1 through 3 illustrating an embodiment of the invention, arm 1 is slightly bent at a point nearer to the top, to which a horizontal hanger holding pipe 2 made of a pipe or a rod is fitted for suspending hangers on it. A rotary lever 3 is pivotably fitted to the upper end of the arm to pivotally move up and down the arm. Of course, the arm 1 may be fitted not to the rotary lever 3 but to the hanger holding pipe 2.

The lower end of said arm 1 is pivotably fitted to a fixed plate 6 by means of a shaft 7, said fixed plate 6 being rigidly fitted to a damper 4 by means of screws 5... such that said arm 1 and hanger holding pipe 2 assembly is pivotable back and forth (up and down).

There is provided a restoring spring 8 as described earlier for pivotally driving said arm to restore its upright or forwardly tilted position in the form of a compression spring, although it may be realized in any other appropriate form. One end (the upper end) of the compression spring 8 in this embodiment is held by a holder ring 9 which is rigidly fitted to the arm 1, while the other end (the lower end) of the restoring spring 8 is supported by a spring receiver 10 which is longitudinally slidably fitted to the arm 1.

Said spring receiver 10 of this embodiment comprises a spring receiver main body 10*a* realized in the form of a reverse U-shape with a view to achieve a smooth sliding motion thereof, a pair of rollers 10*b*, 10*b* having an outer diameter that matches the inner diameter of the arm 1, a pair of receiving guides 10*c*, 10*c* and a pair of pins 10*d*, 10*d* rotatably supported at the outside of the main body 10*a* by way of the receiving guides 10*c*, 10*c*.

Said arm has a bore 1*a* near the upper end thereof formed through drilling and having its opening on one side for rigidly receiving a lever carrier 11, said lever carrier 11 being slightly movable to both sides along a notch 12*a* formed on an arm cover 12 which is rigidly fitted to the upper end of the arm 1 such that the rotary lever 3 is made movable to both sides. It should be noted that the rotary lever 3 is so formed that it can be fitted to said lever 11 from either side by changing its direction with a view to make it possible to be fitted to the arm 1 at the other end of the hanger holding pipe 2.

When the arm 1 is made of a thin walled pipe as shown in FIGS. 1 through 3, a pair of reinforcement plates 13, 13 realized in a gutterlike form are applied to the lower end portion of the arm 1 from outside to reinforce its lower pivot.

One end (the upper end) of each of a pair of link arms 14, 14 is pivotably fitted to the lower end of said spring receiver main body 10*a* by means of one of said pin pair 10*d*, 10*d*. Alternatively, such link arms may be formed in one-piece that have an identical effect.

The lower end of each of the link arms 14, 14 projects outside from one side of the arm 1 through an axial slit 1*b* formed on the arm 1 and pivotably fitted to said fixed plate 6 by means of a pin 15 such that a crank mechanism is constituted by the arm 1, the fixed plate 6 and the link arms 14, 14.

As seen from FIG. 1, the pivot P of each of the link arms 14, 14 is located at a front position relative to the fulcrum 0 and slightly separated downwardly from a horizontal straight line b running through the fulcrum in such a manner that the changing point for the arm 1 coming down to the open position is found on an extension c of the line connecting said pivot P and said fulcrum 0.

Said link arms 14 are pivotably fitted to said arm 1 in such a manner that the arm 1 is inclined to the rear side, or to the left in FIG. 1, relative to the vertical line running through the fulcrum by angle $\alpha$ when it is returned to a totally closed position.

When the arm 1 is turned forward, or to the right in FIG. 1, from the closed position indicated by solid line $R_1$, due to the relative positioning of the lower pivot P of the link arms 14, 14 and the fulcrum 0, the spring receiver 10 is slidably moved so that it is pushed into the arm 1 by the link arms 14, 14 to compress the compression spring to store force necessary to pivotably drive the arm 1 upward.

Deflection of the restoring spring 8 becomes maximum, when the arm 1 comes on the line c and the open position $R_2$ is located on the line which is turned downward from the line c by angle $\oplus$ with a view to stopping the arm 1 at the open position $R_2$ as indicated by two parallel broken lines in FIG. 1.

Therefore, when the arm 1 is pushed up from the open position $R_2$ to a position slightly above the line c, it will be pivotally moved further upward by the driving force stored in the restoring spring 8 until it reaches the closed position $R_1$ where it comes to a standstill.

When said fixed plate 6 is made of a thin metal plate as shown in FIGS. 1 through 3, it is preferable that a disc-shaped bearing 16 having a pair of bosses 16*a*, 16*b* projecting from the disc and a disc-shaped bearing 17 provided with a pair of boss receiving bores 17*a*, 17*b* are fitted to the plate from both sides to form a reinforced integral part.

Preferably, the effective range of the damper 4 for reducing the speed of the downwardly pivoting arm 1 and that of the upwardly pivoting arm 1 are not symmetrical. In view of this, in the embodiment shown in FIGS. 1 through 3, a transmission/disconnection mechanism B is provided between a rotary plate 18 which revolves with a movable shaft (not shown) of the damper 4 and the lower end of the arm 1.

More specifically, a groove 19 having a roughly X-shaped front view is formed on the rotary plate 18 of the damper 4, into which the arm 1 is engaged, said transmission/disconnection mechanism being constituted by the groove 19 and the lower end of the arm 1.

When the arm comes to position $R_3$ as it rotates downward from the closed position $R_1$ by 65°, the arm 1 abuts the upper and lower side walls 19*a*, 19*a* of the groove 19 to activate the damper so that the arm 1 moves under the effect of the damper within the range from position $R_3$ to position $R_2$.

When the arm goes up from the open position to the closed position, or from position $R_2$ to position $R_1$, the arm 1 comes under the influence of the damper at position $R_4$ which is located above position $R_2$ by 100° and continues to be influenced by the damper until it reaches the closed position or position $R_1$. In other words, the groove is so designed as to perform its function as described above.

The point is that, the rotating speed of the arm 1 is reduced when it is turned forward to rotate downward and comes closer to the closed position $R_2$ and when it is turned upward and comes closer to the open position $R_1$ such that the arm 1 respectively slowly reaches the open position $R_2$ and the closed position $R_1$ where it is held completely inmovable.

Said damper 4 as illustrated in the drawings comprises a high molecular viscous fluid such as polyisobutyne filling the space between the fixed plate 20 and the built-in movable shaft (not shown) as well as the space between the movable disc and the plate main body 21 and is sealed by means of an O-ring and a packing such that said movable disc can utilize the viscous shearing resistance of said viscous fluid generated when it is subjected to a turning effort transmitted from, said rotary plate 18 by way of the movable shaft (not shown) of the damper to make the latter very effective for damping external forces applied to it, although its configuration is not limited to the one as described above, but may take any other form involving a known helical spring to be used as the source of drive force.

Figure 5:
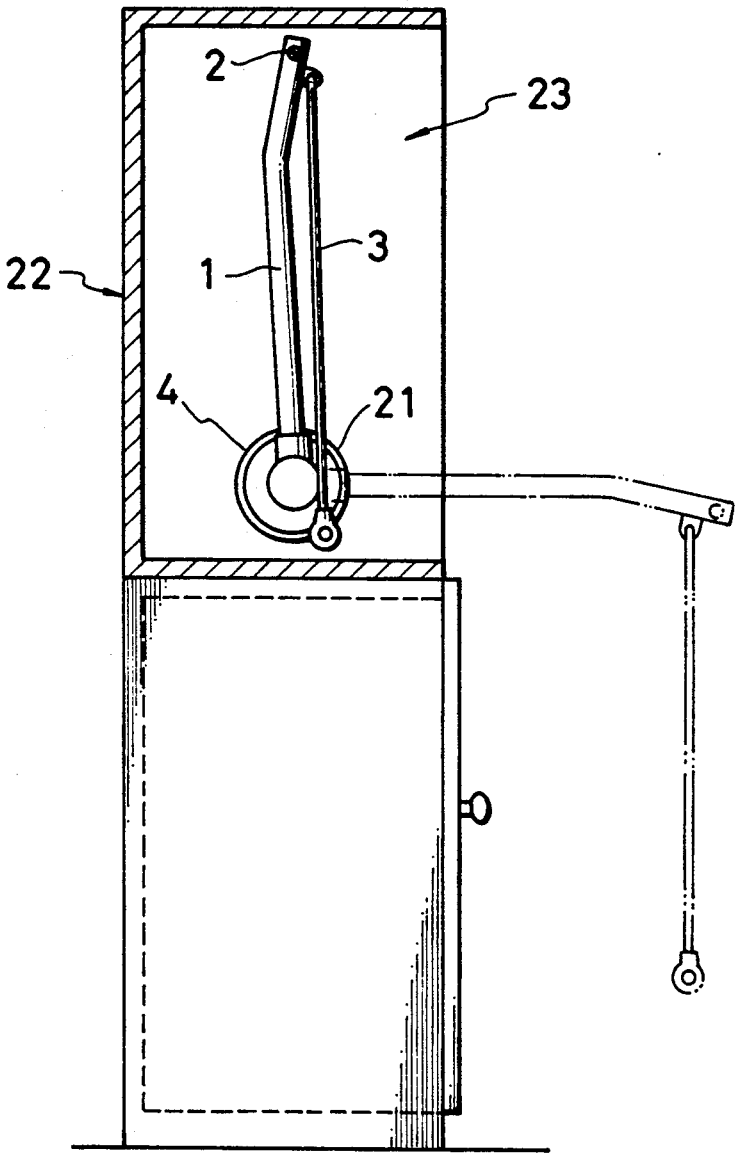

When a damper as described above is used, the plate main body 21 of the damper 4 is rigidly fitted to the inner surface of a lower side wall of the storage chamber 23 provided at an elevated position in the cabinet 22 by means of screws 24 . . . in such a manner that the arm 1 can be tilted forward to take the lowered position as indicated by a pair of broken lines in FIG. 5.

When the arm 1 is returned to the closed position, it is in a standing state as indicated by a pair of solid lines in FIG. 5 and garments (not shown) are stored in the storage area 23 as they are suspended from the hanger holding pipe 2 by using hangers a.

Now, if the rotary lever 3 is pulled forward and downward from the standing state for the closed position, the arm 1 pivots downward around the shaft 7 and is tilted forward to comes to the open position $R_2$ and stops there so that any of the garments stored in the storage area may be taken out or additional garments may be newly stored in the storage area.

Reference numeral 25 in FIG. 2 denotes a cover.

Now the fourth embodiment of the lift coat hanger of the invention described above using damper as illustrated in FIG. 6 comprises a casing 28 having a U-shaped section, at the bottom 28*a* of which there is provided a shaft bearing recess 28*b* as well as a pair of oppositely located grooves 28*d*, 28*d* on the inner periphery 28*c*.

The movable shaft 26 has its one end (or lower end in the drawing) meshed in said shaft bearing recess 28*b* so that it is located along the axis of the casing and freely rotatable around it. The square-shaped head portion 26*a* of the movable shaft 26 projects upward through a shaft through bore 29*a* formed at the center of lid 29 of said casing 28.

Said lid 29 is fitted to said casing 28 by means of a screw bolt which comes to be engaged with a threaded bore 28*e* provided at the top of said casing 28 to sealingly close the casing. Any clearance between the shaft through bore 29*a* and the movable shaft 26 is also airtightly sealed by means of a known sealing material.

The end of said square-shaped head portion 26*a* that projects upward is meshed with a square bore 1*a* of the arm 1 to which external force is applied. Said arm 1 is rigidly fitted to said square-shaped portion 26*a* by means of a screw bolt 30 which comes to be engaged with a threaded bore not shown provided at a lateral side of said square-shaped head portion 26.

Figure 6:
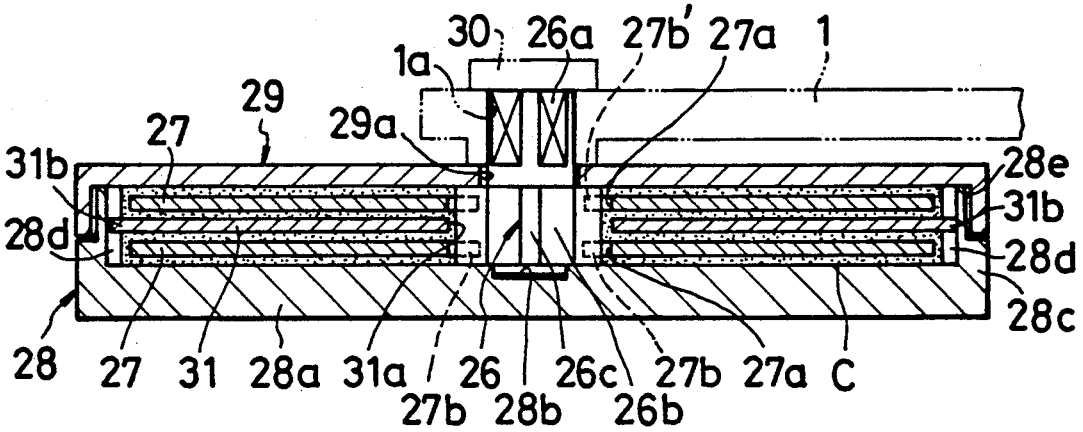
FIG. 6 is a longitudinal sectional view of a damper realized by using viscous liquid.

The inside space of the casing is filled with a high molecular viscous fluid such as polyisobutylene or other viscous fluid C such as pitch or highly viscous water glass and then sealed by a lid 29. It should be noted that a number of movable discs and fixed discs are axially and alternately arranged in the casing. In the case of FIG. 6, a fixed disc 31 is arranged between a pair of movable discs 27.

More specifically, a spline 26*b* is formed on said movable shaft 26 at a position found within said casing 28, while a shaft through bore 27*a* is formed at the center of each of said movable discs 27 such that the shaft through bores 27*a* has a diameter greater than that of said spline 26*b*. Besides, a plurality of catches 27*b* . . . (four in the case of FIG. 6) are arranged on the inner periphery of each of said shaft through bores 27*a* and equally spaced apart from one another such that they are standing toward the center of the bore and engaged with said spline 26*b* to rotate said movable discs 27 when said movable shaft 26 is rotated. It should be noted that the engagement of the catches 27*b* . . . of the movable disc pairs and the spline 26*b* is realized with clearances D which are different in terms of periperal direction.

More specifically, the spline 26*b* is realized by forming four axial ridges 26*c* . . . on the periphery of said movable shaft 26 which are separated from one another with a same distance, said axial ridges 26*c* . . . , and said four catches 27*b* . . . of each of the movable discs 27 are so arranged that they come to abut the lateral side of the corresponding ridges 26*c* . . . .

It may needless to say that each of said movable discs 27 is axially movable relative to the movable shaft, or movable toward the upper or lower end of the casing.

The fixed disc 31 comprises a shaft through bore 31*a* having a diameter larger than the diameter of the spline 26 on said movable shaft 26 so that the movable shaft 26 is idle with respect to the fixed disc 31 when it is rotated.

A plurality of pawls 31*b*, 31*b* are symmetrically arranged on the outer periphery of the fixed disc 31 and come to abut a side wall of corresponding axial grooves 28*d* formed on the inner surface of the casing 28 such that said fixed disc 31 is not affected by the rotational movement of said movable shaft 26. Like the movable discs 27, the fixed disc 31 is axially movable.

When a damper having an arrangement as described above is to operate and an external force is applied to the arm 1 to rotate it, the movable disc does not rotate until, if the movable shaft is rotated by the arm, the axial ridges 26*c* . . . of its spline 26*b* do not come to be engaged with the catches 27*b* of the movable discs 27 and hence no viscous shearing resistance is generated.

Figure 7:
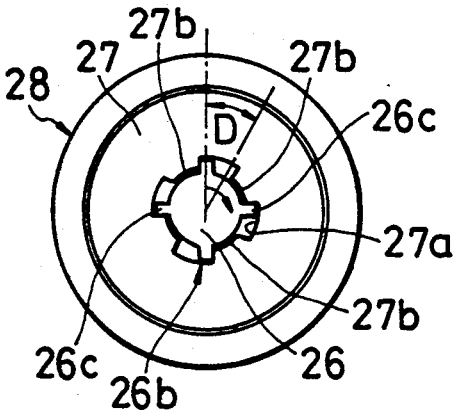
FIGS. 7 through 10 are plan views of the damper of FIG. 6 sequentially illustrating the operation of the movable shaft and the movable disc.
Figure 9:
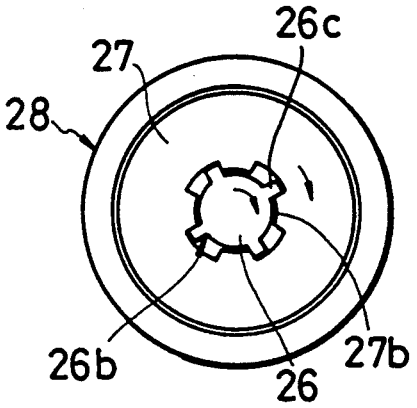
Figure 8:
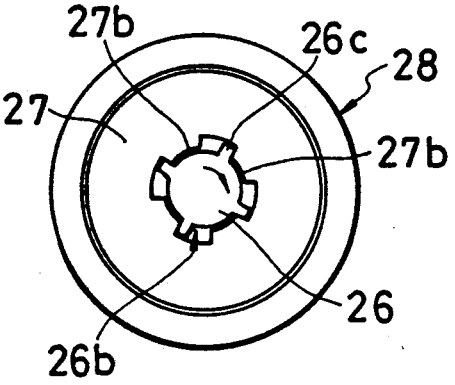
Figure 10:
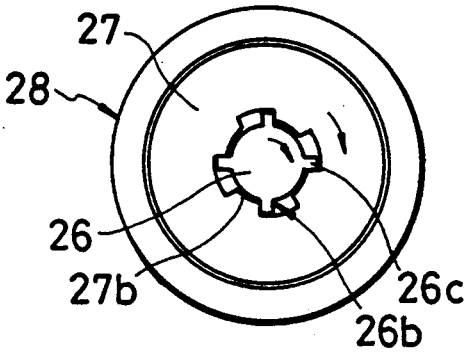

Now, when the movable shaft 26 is rotated from the state as shown in FIG. 7 to the state shown in FIG. 8, or by an angle that corresponds to the clearance D, the spline 26*b* come to abut the catches 27*b* of the movable disc 27 such that the movable discs 27 begin to rotate with the movable shaft 26 to generate viscous shearing resistance in the viscous fluid D filling the spaces between the movable discs 27 and the fixed disc 31.

While two movable discs 27 and a fixed disc 31 are used in the embodiment shown in FIG. 6, more than two movable discs 27 . . . and more than one fixed discs 31 . . . may be used depending on the operational requirements of the damper. Alternatively, only one movable disc 27 may be used by eliminating the use of a fixed disc 31.

EFFECTS OF THE INVENTION

Since the first embodiment of the lift coat hanger of the invention comprises a damper that can be selectively operated with a view to decelerate the rotary motion of the arm and softly stopping it as it comes to the open or closed position, while the construction of the overall lift coat hanger is made rather simple and hence can be realized at a reduced cost.

The second embodiment of the invention utilizes a compression spring for a restoring spring, which is compressed by way of a crank mechanism as the arm is rotated downward to store force to drive back said arm. Such a construction allows modification of the torque transmitted to the arm by changing the replaceable link arm such that the torque becomes maximum when the arm comes to the middle of its stroke and decreases as it approaches the upper or lower end. At the same time, the effective areas of the damper can be made asymmetrical in terms of the upward and downward movements of the arm such that the rotational speed of the arm is reduced as it approaches the closed position $R_1$ or the open position $R_2$ until it completely stops and is held there, while the arm can give a touch of lock-ON and lock-OFF condition to the operator at the open position $R_2$ to ensure a safe and smooth operation of the arm.

The third embodiment of the invention comprises a transmission/disconnection mechanism simply constituted by a groove having an X-shaped plan view formed on the rotary plate which is engaged with the lower end portion of the arm to selectively bring forth the damping effect of the damper in predetermined areas of the stroke of the arm.

The fourth embodiment of the invention comprises a transmission/disconnection which is, unlike the one in the third embodiment, provided between the rotationally movable shaft and the movable discs of the damper. Such an arrangement ensures that the damper becomes effective precisely in the predetermined areas of the stroke of the arm.

What is claimed is:

1. A lift coat hanger comprising a hanger pipe for holding hangers, an arm capable of being pivotally tilted downwardly forward and returned to its upright standing position for moving said hanger pipe up and down, wherein said hanger pipe is horizontally extending from and fitted to an upper end of said arm, a rotary lever pivotally connected at one end to the upper end of said arm and extending along a length of said arm to a lower end of said arm in the upright position of said arm so as to be swung out when said arm in tilted forward and an opposite free end of said rotary lever being located adjacent to the lower end of said arm in the upright position of said arm for tilting and returning said arm by pulling and pushing the free end of said rotary lever.

a restoring spring means capable of restoring the arm from its forwardly tilted open position to its upright standing closed position by using the force stored in it by the arm when the arm is forwardly pivoted from the upright standing closed position to the forwardly tilted open position by pulling on the free end of said rotary lever, a damper connected with the lower end of said arm for damping the rotary motion of said arm transmitted thereto from said arm by means of a movable shaft so as to reduce the rotational speed of said arm when pivoted between its upright standing closed position and its forwardly tilted open position, and a transmission/disconnection mechanism provided between said movable shaft of the damper and the lower end of the arm to make said damper selectively operational only within a predetermined range where the arm is moved down and comes close to the forwardly tilted open position by pulling on the free end of said rotary lever and a corresponding range where the arm is moved up and reaches the upright standing closed position by pushing on the free end of said rotary lever.

2. A lift coat hanger comprising a hanger pipe for holiday hangers, an arm capable of being pivotally tilted downwardly forward and returned to its upright standing position for moving said hanger pipe up and down, wherein said hanger pipe is horizontally extending from and fitted to an upper end of said arm, a rotary lever pivotally connected at one end to the upper end of said arm and extending along a length of said arm to a lower end of said arm in the upright position of said arm so as to be swung out when said arm is tilted forward and an opposite free end of said rotary lever being located adjacent to the lower end of said arm in the upright position of said arm for tilting and returning said arm by pulling on the free end of said rotary lever, a restoring spring means capable of restoring the arm from its forwardly tilted open position to its upright standing closed position by using the force stored in it by the arm when the arm is forwardly pivoted from the upright standing closed position to the forwardly tilted open position by pulling on the free end of said rotary lever, a damper connected with the lower end of said arm for damping the rotary motion of said arm transmitted thereto from said arm by means of a movable shaft so as to reduce the rotational speed of said arm when pivoted between its upright standing closed position and its forwardly tilted open position, said damper including a casing, viscous liquid contained in said casing and a movable shaft and having a damping effect by the viscous shearing resistance of the viscous liquid against the rotary movement of the movable shaft, and a transmission/disconnection mechanism provided between said movable shaft of the damper and the lower end of the arm to make said damper selectively operational only within a predetermined range where the arm is moved down and comes close to the forwardly tilted open position by pulling on the free end of said rotary lever and a corresponding range where the arm is moved up and reaches the upright standing closed position by pushing on the free end of said rotary lever.

* * * * *